US007832184B2

(12) United States Patent
Sillince

(10) Patent No.: US 7,832,184 B2
(45) Date of Patent: Nov. 16, 2010

(54) CONTAINER, ADDITIVE CHAMBER, AND METHOD FOR FILLING A CONTAINER

(75) Inventor: Mark Erich Sillince, Rustington (GB)

(73) Assignee: Packaging & Product Innovations Europe B.V., Blaricum (NL)

( * ) Notice: Subject to any disclaimer, the term of this patent is extended or adjusted under 35 U.S.C. 154(b) by 62 days.

(21) Appl. No.: 12/160,791

(22) PCT Filed: Jan. 12, 2007

(86) PCT No.: PCT/NL2007/050013

§ 371 (c)(1),
(2), (4) Date: Sep. 22, 2008

(87) PCT Pub. No.: WO2007/081210

PCT Pub. Date: Jul. 19, 2007

(65) Prior Publication Data

US 2009/0301032 A1 Dec. 10, 2009

(30) Foreign Application Priority Data

Jan. 12, 2006 (WO) ..... PCT/NL2006/050008

(51) Int. Cl.
*B65B 31/02* (2006.01)
*B65D 25/08* (2006.01)

(52) U.S. Cl. ..... 53/420; 53/471; 53/474; 53/511; 426/106; 426/112; 426/131; 426/394; 426/519; 206/219; 206/568

(58) Field of Classification Search ..... 53/420, 53/432, 433, 471, 474, 511, 95; 426/106, 426/112, 115, 116, 118, 120, 131, 394, 395, 426/519; 206/219–222, 568
See application file for complete search history.

(56) References Cited

U.S. PATENT DOCUMENTS 3,995,778 A * 12/1976 Gamadia ..... 222/399
4,524,805 A * 6/1985 Hoffman ..... 137/846
5,439,137 A 8/1995 Grollier et al.
5,584,165 A * 12/1996 Wright ..... 53/432
5,620,725 A * 4/1997 Jamieson et al. ..... 426/112

(Continued)

FOREIGN PATENT DOCUMENTS

DE 31 28 845 A1 7/1983

(Continued)

*Primary Examiner*—Hemant M Desai
(74) *Attorney, Agent, or Firm*—Young & Thompson

(57) ABSTRACT

A container has a product chamber for containing a product. The product chamber has a product opening that opens into the exterior. A closure member is releasably mounted on the product opening. The container further includes an additive chamber for containing an additive, and a pressure valve that connects the additive chamber and the product chamber with each other. The pressure valve has a closed position when the pressure inside the product chamber is higher than the pressure inside the additive chamber, and an open position for discharging additive from the additive chamber into the product chamber when the pressure inside the product chamber is lower than the pressure inside the additive chamber. The pressure inside the product chamber is higher than the ambient pressure and the pressure inside the additive chamber is both lower than the pressure inside the product chamber and higher than the ambient pressure.

28 Claims, 7 Drawing Sheets

U.S. PATENT DOCUMENTS

| | | | | | |
|---|---|---|---|---|---|
| 5,683,732 | A | * | 11/1997 | Baxter et al. | 426/115 |
| 5,705,209 | A | * | 1/1998 | Wright et al. | 426/112 |
| 5,705,210 | A | * | 1/1998 | Sillince et al. | 426/112 |
| 5,827,555 | A | * | 10/1998 | Thorne et al. | 426/112 |
| 6,390,292 | B2 | * | 5/2002 | Hawthorne | 206/219 |
| 6,896,920 | B1 | * | 5/2005 | Forman et al. | 426/106 |
| 2003/0148003 | A1 | | 8/2003 | Wright | |

FOREIGN PATENT DOCUMENTS

| | | | |
|---|---|---|---|
| GB | 2 285 793 | A | 7/1995 |
| JP | 2000-335652 | A | 12/2000 |
| WO | 93/24384 | A | 12/1993 |
| WO | 98/56678 | A | 12/1998 |
| WO | 03/039992 | A1 | 5/2003 |

* cited by examiner

CONTAINER, ADDITIVE CHAMBER, AND METHOD FOR FILLING A CONTAINER

This application claims the benefit under 35 U.S.C. Section 371, of PCT International Application No. PCT/NL2007/50013, filed Jan. 12, 2007, which claimed priority to Netherlands PCT/NL2006/050008, filed Jan. 12, 2006.

The invention relates to a container, such as a bottle or jar, comprising a product chamber for containing a product, which product chamber has a product opening that opens into the exterior, a closure member that is releasably mounted on the product opening, and an additive chamber for containing an additive.

In this patent application the terms "product" and "additive" merely indicate a first composition and a second composition, respectively. These two compositions, i.e. the product and the additive, may each comprise one or more components and/or ingredients. The product and additive form two different compositions.

A container for mixing of a product and an additive is known. For example, the product chamber of the container is filled with water, while the additive chamber contains a drink concentrate. For consumption the consumer must first remove the closure member from the product opening. Then, he must break the additive chamber and subsequently pour the drink concentrate into the product opening. Finally, he must shake the container in order to mix the drink concentrate with the water. Thus, the preparation of this mixed drink is rather cumbersome.

It is an object of the invention to provide an improved container for a product and an additive.

This object is achieved according to the invention in that the container comprises a pressure valve that connects the additive chamber and the product chamber with each other, which pressure valve has a closed position when the pressure ($p_1$) inside the product chamber is higher than the pressure ($p_2$) inside the additive chamber, and has an open position for discharging additive from the additive chamber into the product chamber when the pressure ($p_1$) inside the product chamber is lower than the pressure ($p_2$) inside the additive chamber, and in that the pressure ($p_1$) inside the product chamber is higher than the ambient pressure ($p_{atm}$) and the pressure ($p_2$) inside the additive chamber is both lower than the pressure ($p_1$) inside the product chamber and higher than the ambient pressure ($p_{atm}$).

Before consumption or use, the closure member closes off the product opening. Then the pressure valve is closed, because the pressure ($p_1$) inside the product chamber is higher than the pressure ($p_2$) inside the additive chamber. The pressure valve provides an exclusive communication between the additive chamber and the product chamber. Thus the additive chamber and the product chamber are separated from each other as long as the closure member remains installed. To enable consumption or use the closure member is removed from the product opening. As a result, the pressure ($p_1$) inside the product chamber will drop below the pressure ($p_2$) inside the additive chamber. Then, the pressure valve opens such that the additive flows via the discharge opening of the pressure valve into the product chamber. Thus, the preparation of the mixture of the product and the additive is simplified according to the invention.

It is noted that GB 2 285 793 discloses a beverage container comprising a primary chamber containing a beverage and an hollow insert forming a secondary chamber. The insert comprises a duckbill valve to provide communication between the interior of the insert and the beverage in the primary chamber.

However, this beverage container does not deal with keeping two compositions separate until the time of consumption and is not suitable for that purpose either. After all, the insert comprises a permanent orifice or further duckbill valve to allow gas from the beverage into the insert. The insert and the primary chamber are thus in communication with each other when the beverage container is closed. The internal pressure of the primary chamber and the insert remain in equilibrium as the duck-bill valve allows gas from the insert into the beverage. Thus, the contents of the insert will leak into the beverage before opening the container.

Upon opening the container the pressure in the container rapidly vents to atmospheric pressure, creating a pressure difference between the inside and the outside of the insert. Thus, the gas is jetted into the beverage from the insert via the duckbill valve. The jet of gas causes shear in the beverage. As the beverage is poured out of the container and into a drinking glass, the shear gives the appearance of dispensing the beverage from draught.

The known insert can also be pre-pressurized before sealing the container. In this case the insert will initially be pressurized with a gas to a pressure equal or slightly exceeding the super-atmospheric pressure of the primary chamber. If a slight pressure difference exists, the gas will flow through the duckbill valve from the insert into the primary chamber until the pressure inside the insert is equal to the pressure inside the sealed primary chamber after closing the primary chamber. This will result in the desired shear, but causes leakage of the gas from the insert into the beverage before opening the container.

According to the invention a negative pressure difference between the inside and outside of the additive chamber already exists before opening the container, i.e. the pressure in the additive chamber is lower than the pressure in the product chamber. Therefore, the duckbill valve ensures that the contents of the product chamber and the additive chamber remain reliably separated until opening the container.

Although the beverage container according to the invention deals with keeping two compositions separate until the time of consumption, the additive that is injected upon opening will also cause shear in the beverage. This is a visual advantage of the invention as well.

It is preferred according to the invention that the pressure ($p_1$) inside the product chamber is higher than the ambient pressure ($p_{atm}$) and the pressure ($p_2$) inside the additive chamber is both lower than the pressure ($p_1$) inside the product chamber and higher than the ambient pressure ($p_{atm}$).

While the closure member is mounted on the product opening, it closes off the product chamber. Then, an overpressure with respect to the surroundings prevails in the product chamber, because the pressure ($p_1$) inside the product chamber is higher than the ambient pressure ($p_{atm}$). The additive chamber also comprises an overpressure with respect to the surroundings, because the pressure ($p_2$) inside the additive chamber is higher than the ambient pressure ($p_{atm}$). However, the overpressure in the additive chamber is less than the overpressure in the product chamber—the pressure ($p_2$) inside the additive chamber is lower than the pressure ($p_1$) inside the product chamber. Thus, the product chamber depressurizes as soon as the closure member is removed from the product opening, i.e. the pressure ($p_1$) inside the product chamber drops. As a result, the additive chamber depressurizes via the pressure valve into the product chamber. Thus, the additive is forced into the product chamber.

In an embodiment the additive chamber comprises an access opening that opens to the exterior of the container, which access opening is sealed. The access opening is suitable for supplying additive into the additive chamber and/or for pressurising the additive chamber. The access opening can provide access from the outside to the interior of the additive chamber after it has been installed in the bottle. Thus, it is possible to fill and pressurize the additive chamber after the product chamber has been filled and sealed, the additive chamber being attached inside the product chamber. The insert can be charged from outside the already filled and sealed container. Also, the access opening allows pressurizing the product chamber through the additive chamber and the pressure valve after the product chamber has been filled and sealed. The access opening is therefore advantageous for (mass) production of the container, e.g. the pressures $p_1$ and $p_2$ can be controlled accurately while maintaining relatively low manufacturing costs. After charging the additive chamber, the access opening is sealed.

It is possible that the access opening is provided with a further pressure valve that has a closed position when the pressure ($p_2$) inside the additive chamber is higher than the ambient pressure ($p_{atm}$), and has an open position defining a supply opening for supplying additive into the additive chamber and/or for pressurising the additive chamber when the pressure ($p_a$) exerted on the pressure valve from outside the additive chamber is higher than the pressure ($p_2$) inside the additive chamber. This allows easy filling and pressurising of the additive chamber when installed in the already filled product chamber.

Alternatively, the access opening is provided with a plug or any other sealing member. The additive chamber having the access opening can be filled with additive in a pressurised environment with the pressure being what is desired inside the additive chamber, i.e. $p_2$. Thereafter, the plug is installed in the access opening, closing off the additive chamber. The pressure $p_2$ can be controlled accurately in this manner.

According to the invention the product chamber can be filled with a product leaving clear a head space comprising a pressurized gas at the pressure ($p_1$) that is higher than the ambient pressure ($p_{atm}$). During filling of the product chamber the head space is left clear. Subsequently, the gas of the head space is pressurized providing an overpressure in the product chamber.

Similarly, it is possible according to the invention that the additive chamber is filled with an additive leaving clear a head space comprising a pressurized gas at the pressure ($p_2$) that is both lower than the pressure ($p_1$) inside the product chamber and higher than the ambient pressure ($p_{atm}$). Thus, the overpressure inside the additive chamber is effectively realised.

The container according to the invention can be constructed in various ways. For example, the container comprises a base and a circumferential wall that extends from the base, wherein the product opening is provided at the end of circumferential wall facing away from the base, wherein the additive chamber is attached to the base of the container. This leads to attractive visual effects when the additive is pressure-driven into the product chamber.

The base of the container may comprise a cavity, wherein the additive chamber is attached from the outside into the cavity. As a result, the additive chamber can be installed after the product chamber has been filled.

It is possible according to the invention that the additive comprises a liquid, and wherein the additive chamber comprises a discharge tube that extends from the discharge opening, which discharge tube has an inflow opening that is submerged into the liquid additive.

When a consumer removes the closure member from the product opening, he will hold the container according to the invention in an opening position. In this position of the container, the passage or inflow opening of the discharge tube is submerged into the liquid additive, i.e. the discharge tube is at least partially filled with the liquid additive. In other words, the additive chamber is filled with liquid additive until the level of the liquid additive reaches above the passage opening of the discharge tube. The liquid is incompressible, whereas the gas in the head space acts as a spring. The pressurized head space above the liquid level can drive the liquid additive through the passage opening into the discharge tube, so that the liquid additive is injected into the product chamber via the discharge opening of the pressure valve.

In a specific embodiment of the invention the additive chamber can comprise a holder defining an interior that is in communication with the interior of the discharge tube via the passage opening. The passage opening provides an exclusive communication between the interior of the holder and the interior of the discharge tube. Thus, the holder encloses an interior that is separated from the interior of the discharge tube via the passage opening.

When the container is held in its opening position, usually the upright position, the head space then comprises a head space portion within the holder and a head space portion within the discharge tube, which head space portions are separated from each other by the liquid additive and the discharge tube wall. In other words, the pressurized head space above the level of the liquid additive comprises two portions. The first portion is located in the holder, i.e. outside the discharge tube, and the second portion extends inside the discharge tube.

Thus, the head space portion in the holder comprises pressurized gas that is separated by the liquid additive from the pressurized gas of the head space portion in the discharge tube. Consequently, the pressurized gas in the head space portion in the holder can only escape through the inflow opening of the discharge tube, the discharge tube itself and the discharge opening of the pressure valve by pushing the liquid additive in front of it. This means that the pressurized gas in the holder will force the liquid additive out of the additive chamber after the closure member is removed.

In an alternative embodiment, the additive chamber is attached to the closure member that is releasably mounted on the product opening. The access opening may then be provided in the closure member. When the container comprises a bottle made of glass, e.g. a beer bottle, it is difficult or even impossible to attach the additive chamber to the bottle. When the additive chamber is attached to the closure member, for example a crown cap, the container according to the invention can include a bottle made of any material, such as glass or PET.

The pressure valve between the additive chamber and the product chamber can be attached and sealed in various ways. For example, the additive chamber comprises an accommodating opening for accommodating the pressure valve, which accommodating opening is defined by a circumferential edge, and wherein the pressure valve comprises a flexible material, and is provided with an end flange and a circumferential sealing skirt at a distance from the end flange, and wherein said circumferential edge of the accommodating opening is clamped between the end flange and the sealing skirt.

The sealing skirt of the flexible pressure valve deforms under the influence of the pressure inside the product chamber. As a result, a liquid-tight seal is formed between the accommodating opening of the additive chamber and the pressure valve. The fluid from the product chamber cannot leak between the pressure valve and the accommodating opening.

It is possible that the cavity comprises a further accommodating opening for accommodating the pressure valve, which further accommodating opening is defined by a further circumferential edge that is aligned with the circumferential edge of the additive chamber, and wherein the circumferential edges of both accommodating openings are clamped between the end flange and the sealing skirt. Thus, both the additive chamber and the cavity have an accommodating opening, respectively, for the pressure valve. These accommodating openings are aligned with respect to each other. The edges of the accommodating openings are clamped between the end flange and the sealing skirt of the pressure valve. When the additive chamber is attached into a cavity of the base wall, the surface area over which the pressure inside the product chamber is acting reduces significantly. As a result, the force applied onto the additive chamber pushing it out of the container is lower.

According to the invention it is preferred that the pressure valve is a one way valve or non-return valve. As a result, the discharge opening of the additive chamber is an exit only—leakage of product into the additive chamber is excluded.

For example, the one way valve comprises a duckbill valve. A duckbill valve can be moulded efficiently in plastic using proven technology. It can be integrated in one piece, whereas it is easy to split open the discharge opening during production, e.g. using pressurized air.

In most cases, a duckbill valve comprises a beak having two beak portions that can move with respect to each other, which beak portions abut against each other in the closed position and define a slit in the open position, wherein the beak portions have outside surfaces and inside surfaces that, wherein the beak portions are forced against each other into the closed position under the influence of a pressure exerted on the outside surfaces, and wherein the beak portions are forced away from each other for opening the slit of the open position under the influence of a pressure exterted on the inside surfaces. When this duckbill valve forms the pressure valve between the product chamber and the additive chamber, the outside surfaces each face towards the product chamber and the inside surfaces each face towards the additive chamber.

According to the invention the additive chamber can have a further pressure valve that has a closed position when the pressure ($p_2$) inside the additive chamber is higher than the ambient pressure ($p_{atm}$), and has an open position defining a supply opening for supplying additive into the product chamber when the pressure ($p_a$) exerted on the pressure valve from outside the additive chamber is higher than the pressure ($p_2$) inside the additive chamber.

Before filling of the additive chamber the pressure therein is preferably low, i.e. equal to or below the ambient pressure $p_{atm}$. During filling of the additive chamber the pressure $p_a$ applied to the pressure valve is kept slightly above the pressure prevailing in the additive chamber. This ensures that the additive chamber can be filled with the desired amount of additive, and reduces or eliminates the risk of leakage to the product chamber. Also, the pressure applied to the pressure valve during filling is less than the pressure in the product chamber, so that the pressure valve between the additive chamber and the product chamber remains closed. The additive chamber remains separated from the product chamber during filling. After filling the additive chamber the pressure on the further pressure valve is released. Then, the pressure inside the additive chamber is higher than the ambient pressure, which forces the further pressure valve into its closed position. The further pressure valve prevents leakage of additive from the additive chamber into the environment.

Although the container according to the invention can have various applications, the container according to the invention is particularly suitable for containing beverages. For beverage applications the additive within the container according to the invention can comprise vitamins. A product that contains vitamins is usually perishable, because the vitamins in contact with the liquid product will not be stable for a long time, e.g. due to oxidation. According to the invention the vitamins in the additive chamber are kept in optimum condition. After the consumer removes the closure member the vitamins are injected into the product chamber and the vitamins are consumed at their highest functionality. Thus it is very simple to prepare a beverage containing "freshly" added vitamins.

For example, it is known that vitamin C will deteriorate in aqueous and alcoholic liquids, i.e. it is difficult to keep an aqueous and/or alcoholic beverage containing added vitamin C. According to the invention an aqueous and/or alcoholic product and the vitamin C additive can be separately contained within the container, whereas they are mixed only just before consumption by opening the container.

It is possible according to the invention that the additive comprises proteins and/or peptides, such as casein hydrolysates, and/or carotenoids, such as lycopene, and/or anti-oxidants, such as quercitin, and/or flavourants, such as a flavoured concentrate or flavour extracts.

Proteins and peptides have several functionalities. For example, various proteins and peptides are "muscle refueling". However, these compounds deteriorate in alcohol. As a consequence, they may cause a bitter taste and/or decreased functionality. With the container according to the invention it is possible to produce an alcoholic sports drink. The alcoholic product, such as beer, is then filled in the product chamber, whereas the additive chamber contains casein hydrolysates or any other proteins and/or peptides. Such a "sports beer" is particularly advantageous according to the invention.

Proteins and peptides also deteriorate in acid liquids, i.e. liquids having pH<7. Most soft drinks, such as cola, are acid. The container according to the invention also enables the combination of an acid soft drink in the product chamber and proteins and/or peptides in the additive chamber, which results in a "sports soft drink". This combination is also advantageous according to the invention.

Carotenoids, such as lycopene, improve sight of the consumer. Depending on the pH-value, they will influence the overall colour of the beverage. Anti-oxidants, such as qeurcitin, have various functionalities as well. For example, anti-oxidants are believed to reduce the formation of wrinkles. Therefore, these additives are also particularly advantageous for being received in the additive chamber of the container according to the invention. The invention allows these additives to be combined with water, beer, milk or any other product—contrary to known containers wherein these additives cannot be kept separated from the product.

As an example of a flavourant, such as a flavoured concentrate, the product within the product chamber is still or carbonated water, whereas the additive chamber is charged with liquid syrup. One packaging company can fill the product chambers of the container according to the invention, whereas another company can charge the additive chamber with a flavoured ingredient and fit the additive chamber to the containers. Thus, it is possible to supply a range of flavours of carbonated and still products. The company installing the additive chamber may also be catering industry selling various flavoured drinks or health drinks over the counter.

Many carotenoids, such as lycopene, anti-oxidants, such as quercitin, and flavourants are known to deteriorate under the influence of light. In this case, the additive chamber of the container according to the invention is nontransparent or opaque, whereas the product chamber can be transparent.

The container according to the invention is also suitable for medical applications. In this case, it is possible according to the invention that the product and the additive after mixing thereof comprise a pharmaceutical composition, in particular a medicament. The pharmaceutical composition may require mixing of different components only at the time of use. The container according to the invention provides accurate dosing of these different components—human mistakes are excluded because dosing is automatic. Moreover, the mixing of the different components is completely hygienic.

The container according to the invention is also suitable for cosmetic applications. The container according to the invention can contain a product and an additive that after mixing thereof comprise a cosmetic composition, such as a skin lotion. The cosmetic industry has developed packages for lotions and skin systems that rely on mixing of two or more components at the time of use, e.g. twin pack systems. However, these packages are relatively expensive and do not provide automatic mixing. The container according to the invention provides an inexpensive alternative for packaging of such cosmetic products.

It may be desirable that the additive comprises more than one composition. In a preferred embodiment of the invention the additive comprises at least two liquid compositions that separate after mixing, for example compositions having different densities and/or incompatible chemical properties. Because of the different densities and/or chemical incompatibility these two liquid components float on top of each other within the additive chamber. After depressurizing the product chamber the additive chamber will discharge the liquid components successively. If the liquid components have different colours the consumer will see multiple jets of different colours flowing into the product chamber.

The container according to the invention having a single additive chamber comprising multiple compositions is useful only when the compositions can be kept together without deteriorating their qualities. If the additive comprises multiple compositions that degenerate in the presence of each other, it is advantageous to apply an alternative embodiment of the invention. In this alternative embodiment for supplying different additive components to the product chamber, the additive chamber comprises at least two separated spaces for containing one additive composition, respectively, wherein each separated space is connected to the product chamber by a pressure valve in each case, wherein each pressure valve has a closed position when the pressure ($p_1$) inside the product chamber is higher than the pressure ($p_2$) inside the corresponding separated space of the additive chamber, and has an open position for discharging additive from said corresponding separated space of the additive chamber into the product chamber when the pressure ($p_1$) inside the product chamber is lower than the pressure ($p_2$) inside said corresponding separated space of the additive chamber. In this embodiment, each space of the additive chamber is dedicated to a different additive component.

In this case, it is possible that the pressure ($p_2$) inside the first separated space of the additive chamber differs from the pressure ($p_2$) inside the second separated space of the additive chamber. Then, the additives from the separated spaces are injected into the product chamber consecutively.

The invention also relates to an additive chamber for use with a container as described above. The invention further relates to a use of a container as described above for containing a pharmaceutical composition, in particular a medicament, or a cosmetic composition.

Furthermore, the invention relates to a method for filling a container, comprising:

providing a container, such as a bottle or jar, which container comprises a product chamber for containing a product, which product chamber has a product opening that opens into the exterior, providing an additive chamber for containing an additive, which additive chamber comprises a pressure valve that has a closed position when the pressure ($p_2$) inside the additive chamber is lower than the pressure ($p_1$) outside the additive chamber, and has an open position when the pressure ($p_2$) inside the additive chamber is higher than the pressure ($p_1$) outside the additive chamber, which pressure valve defines a discharge opening in the open position, fitting the additive chamber to the product chamber such that the discharge opening of the pressure valve in the open position opens into the product chamber, filling the product chamber with a product, such as a liquid, closing off the product chamber by releasably mounting a closure member on the product opening, pressurizing the product chamber to a pressure $p_1$ that is higher than the ambient pressure ($p_{atm}$), filling the additive chamber with an additive pressurizing the additive chamber to a pressure ($p_2$) that is both lower than the pressure ($p_1$) inside the product chamber and higher than the ambient pressure ($p_{atm}$).

The above-mentioned steps of the method can be carried out consecutively as listed or can be carried out in a different order.

For example, it is possible that the product chamber is pressurized by applying an overpressure to the pressure valve after the product chamber has been filled with the product and the closure member is mounted on the product opening. The overpressure to the pressure valve can be removed after the product chamber is pressurised to the pressure ($p_1$).

In an embodiment of the method according to the invention, the additive chamber, being fitted in the container, comprises an access opening that opens into the exterior of the container, and wherein additive is supplied into the additive chamber through the access opening and/or the additive chamber is pressurised to a pressure ($p_2$) that is higher than the ambient pressure ($p_{atm}$) by applying said pressure ($p_2$) to the access opening.

The invention will now be explained in more detail with reference to an exemplary embodiment shown in the figures.

Figure 1:
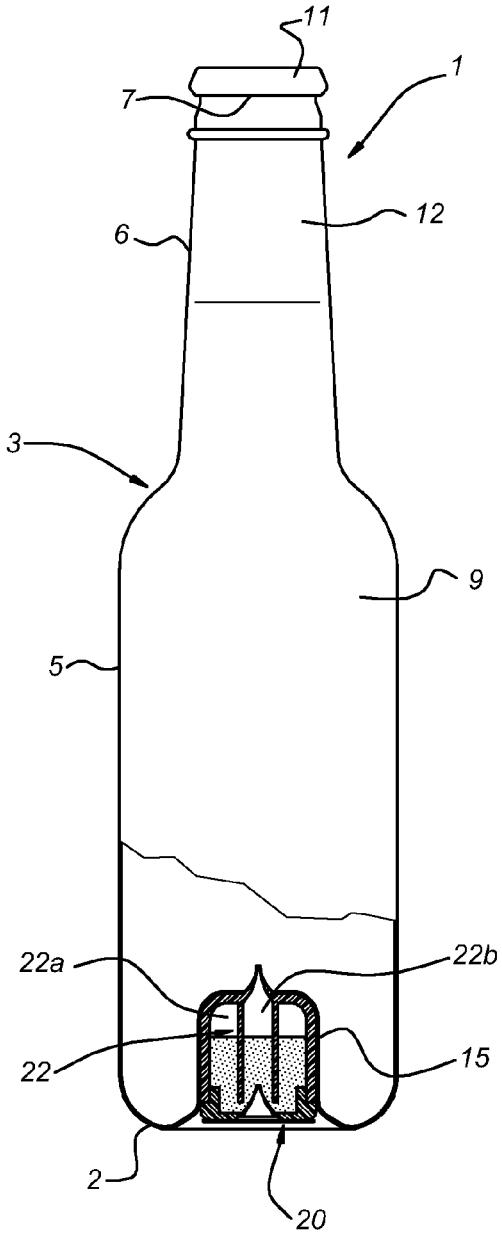
FIG. 1 shows a cross-sectional side view of a container according to the invention, wherein the closure member closes off the product chamber.
Figure 2:
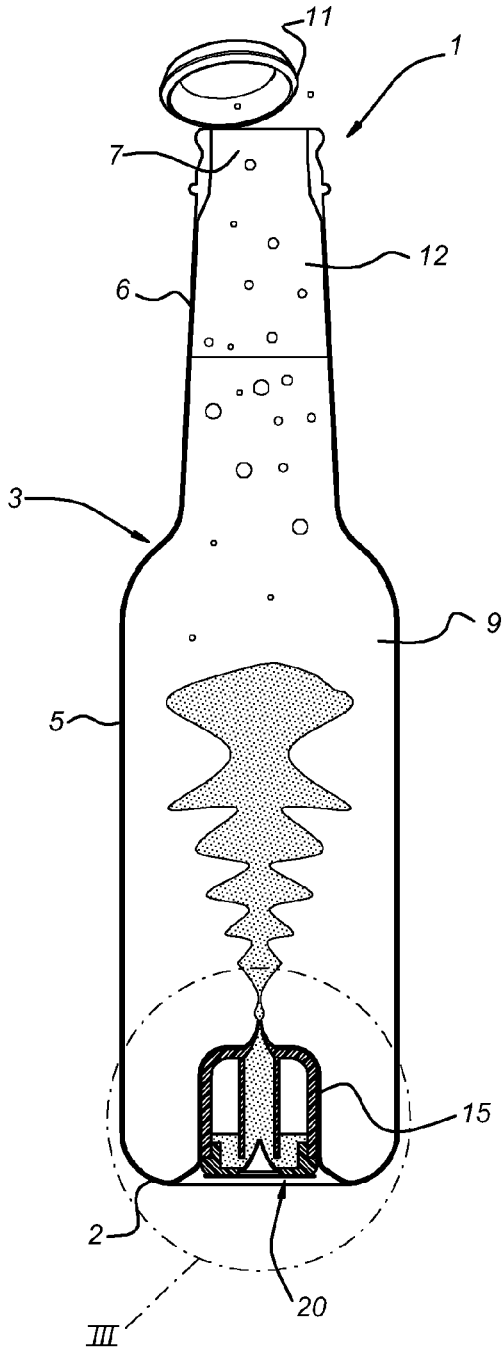
FIG. 2 shows a cross-sectional side view of the container according to FIG. 1, wherein the closure member has just been removed.
Figure 6A:
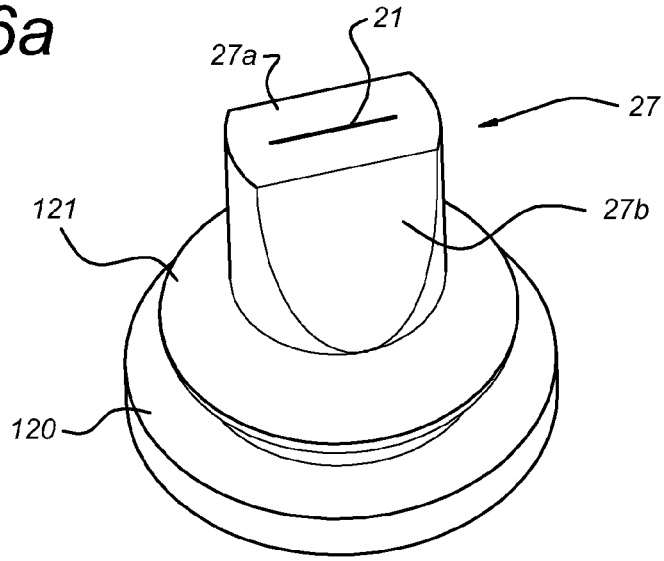

FIG. 6*a* shows a perspective view of a duckbill valve used in the container according to FIG. 1.

Figure 6B:
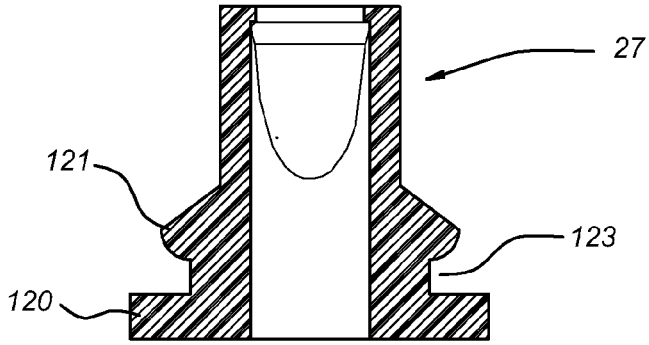

FIG. 6*b* shows a first cross-sectional view of the duckbill valve according to FIG. 6*a*.

Figure 6C:
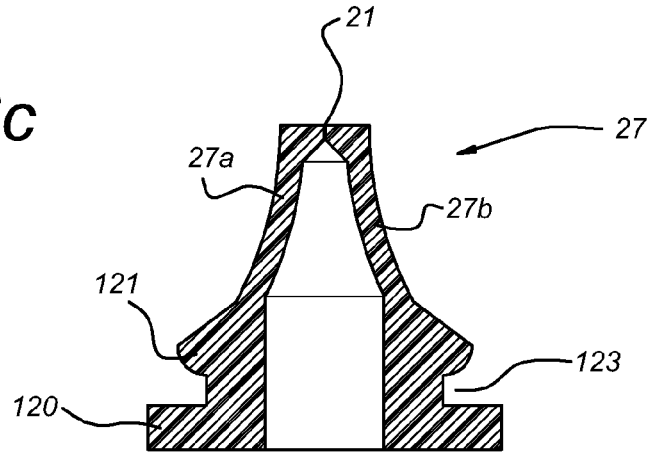

FIG. 6*c* shows a second cross-sectional view of the duckbill valve according to FIG. 6*a*.

Figure 7:
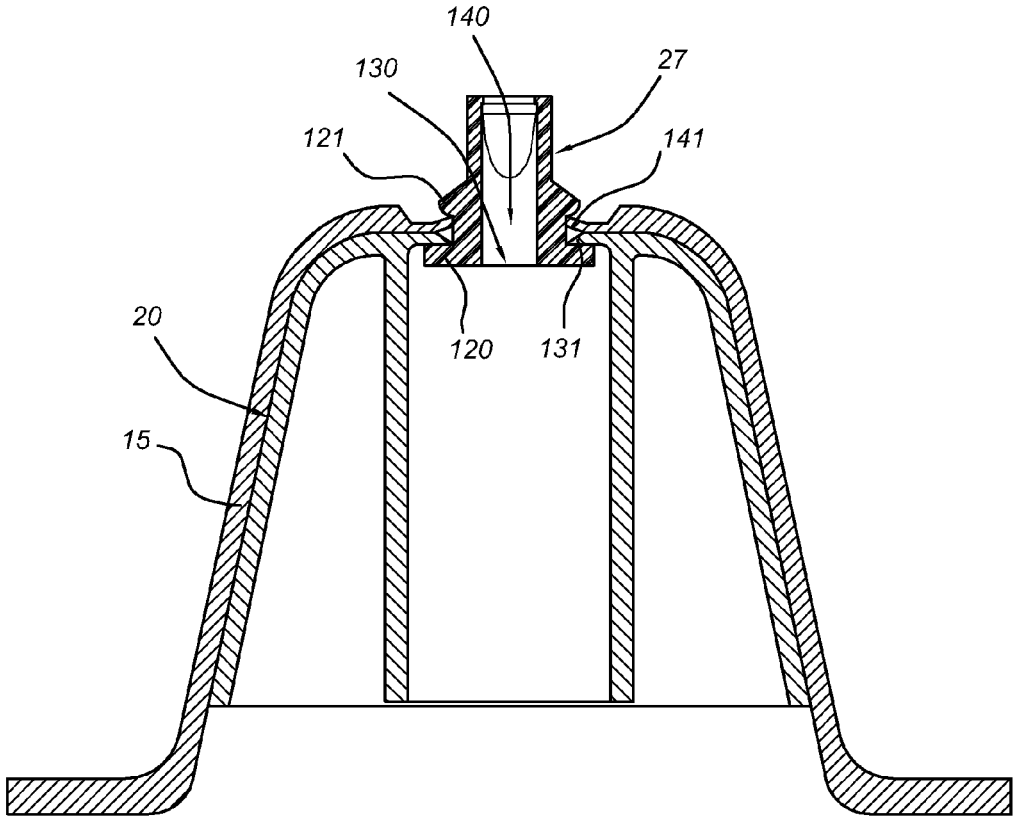

FIG. 7 shows an enlarged cross-sectional view of the duckbill valve according to FIGS. 6*a*-*c* attached into the cavity of the container.

Figure 8A:
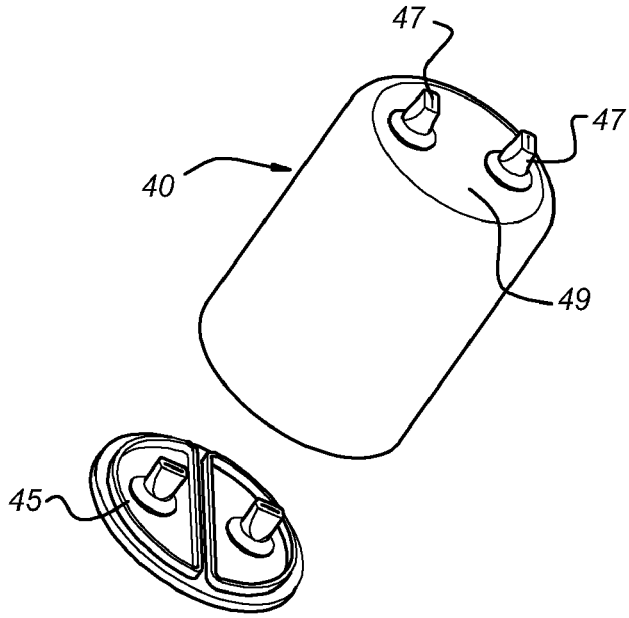
Figure 8B:
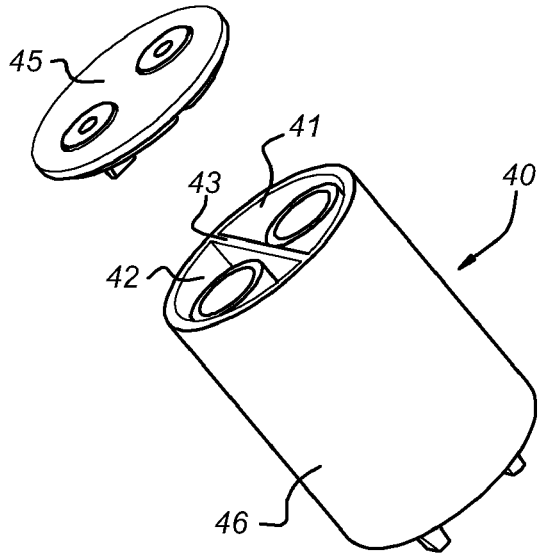

FIG. 8*a*, 8*b* show perspective views of an additive chamber having two separated spaces for containing additive compositions.

Figure 8C:
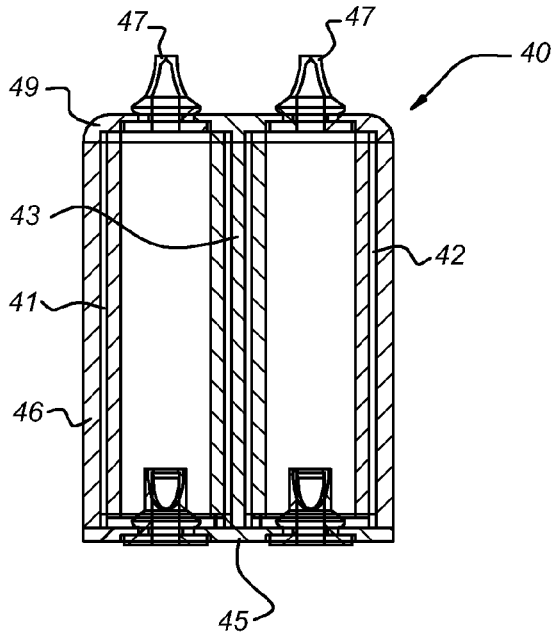

FIG. 8*c* shows a cross-sectional view of the additive chamber according to FIGS. 8*a*, 8*b*.

Figure 9:
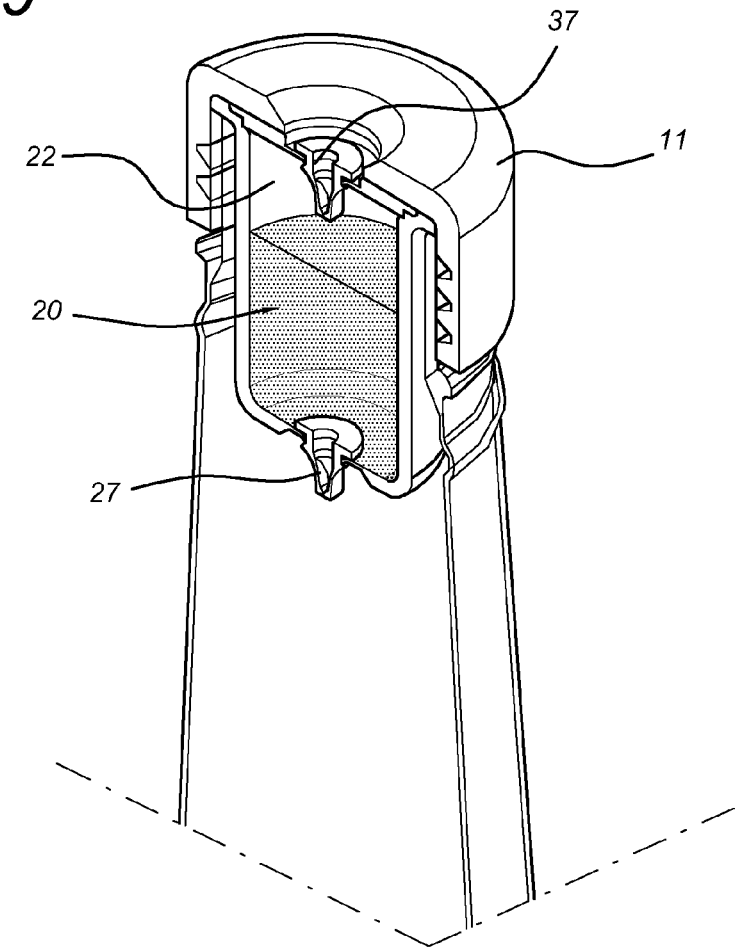

FIG. 9 shows a cross-sectional view of an alternative embodiment of the container according to the invention, wherein the additive chamber is mounted into the closure member.

The container according to the invention is indicated in its entirety by 1. The container 1 comprises a base 2 and a circumferential wall 3 that extends from the base 2. The base 2 of the container 1 comprises a cavity 15. Because the container 1 shown in FIGS. 1-5 is a bottle, the circumferential wall 3 has a body wall 5 adjacent to the base 2 and a neck wall 6 connected to the body wall 5. The base 2 and the circumferential wall 3 define a product chamber 9 for containing a product. For example the product is a liquid, such as still or carbonated water.

The circumferential wall 3 and the base 2 provided with the cavity 15 can be integrated into a single piece. This single piece can be made of PET using injection blow moulding. If desired the PET will be multilayer for providing an oxygen barrier. Obviously it is possible that this piece comprises another material.

The container 1 comprises a product opening 7 at the end of the circumferential wall 3 facing away from the base 2, i.e. at the neck end of the circumferential wall 3. The product opening 7 opens into the exterior. A closure member 11, e.g. a crown cap or a screw cap, is releasably mounted on the product opening 7.

The volume of the product in the product chamber 9 is smaller than the volume of the product chamber 9 itself. When the container 1 has an upright position, the product level will be located below the product opening 7. Thus a head space 12 is kept clear between the product level and the product opening 7. The head space 12 comprises a pressurized gas. As a result the pressure $p_1$ inside the product chamber 9 is higher than the ambient pressure $p_{atm}$.

The container 1 comprises an additive chamber 20 for containing an additive. Although the additive can be any composition, the additive in this exemplary embodiment forms a liquid syrup. The additive chamber 20 is fitted within the cavity 15 of the base 2, e.g. using a snap-fit arrangement (not shown). Of course, the additive chamber 20 may be fixed to the product chamber 9 in a different manner. The additive chamber 20 is shown most clearly in FIGS. 3-5.

The additive chamber 20 comprises a holder 23 having an interior that is annular in cross-section. The holder 23 comprises a bottom wall 23*a* and a circumferential wall 23*b* that extends from the bottom wall 23*a*. A top wall 29 closes the holder 23. The additive chamber 20 is provided with a discharge tube or dip tube 24 that is centrally placed within the holder 23. The discharge tube 24 has a passage opening 25 (see FIG. 3) through which the interior of the discharge tube 24 and the interior of the holder 23 are in communication with each other. As shown in FIG. 1 the passage opening 25 of the discharge tube 24 is submerged into the liquid additive, i.e. the discharge tube 24 is dipped into the liquid additive such that the level of the liquid additive reaches above the passage opening 25 of the discharge tube 24.

The additive chamber comprises a pressure valve 27. The pressure valve 27 is provided at the top of the discharge tube 24 (see FIG. 3). The pressure valve 27 forms a one-way valve or check valve. Although the pressure valve 27 can be any sealing device, such as an umbrella valve or a flapper valve, the one-way pressure valve 27 according to this exemplary embodiment is a duckbill valve. A duckbill valve is particularly suitable for the container 1 according to the invention, because it forms a precision-moulded, one-piece elastomeric valve that provides reliable backflow prevention.

The duckbill valve 27 is also shown separately in detail in FIGS. 6*a*-6*c*. The duckbill valve 27 comprises two beak portions or flaps 27*a*, 27*b* that can deflect under the influence of a pressure difference. The duckbill valve checks backflow with negative differential pressure—if the pressure $p_1$ in the product chamber 9 is higher than the pressure $p_2$ in the discharge tube 24, the flaps 27*a*, 27*b* of the valve 27 will remain closed. Thus, the pressure valve 27 has a closed position when the pressure $p_2$ inside the additive chamber 20 is lower than the pressure $p_1$ outside the additive chamber 20, i.e. inside the product chamber 9.

If overpressure is exerted on the inside surfaces of the valve flaps 27*a*, 27*b*, a slot or slit 21 will be defined between the valve flaps 27*a*, 27*b*. The slot forms a discharge opening 21 that opens into the product chamber 9. The duckbill valve 27 allows free flow with positive differential pressure, i.e. when the pressure $p_2$ in the discharge tube 24 is higher than the pressure $p_1$ in the product chamber 9. In other words, the pressure valve 27 has an open position for discharging additive from the additive chamber 20 when the pressure $p_2$ inside the additive chamber 20 is higher than the pressure $p_1$ outside the additive chamber, i.e. inside the product chamber 9.

As shown most clearly in FIG. 7, the additive chamber 20 comprises an accommodating opening 130 for accommodating the pressure valve 27. The accommodating opening 130 is delimited by a circumferential edge 131. The cavity 15 comprises a further accommodating opening 140 for accommodating the pressure valve 27. The accommodating opening 140 is delimited by a circumferential edge 141 of the cavity 15 that is aligned with the circumferential edge 131 of the additive chamber 20.

The pressure valve 27 is made of a flexible material. It is provided with an end flange 120 and a circumferential sealing skirt 121 at a distance from the end flange 120. There is an accommodating groove 123 between the end flange 120 and the sealing skirt 121. The circumferential edges 131, 141 of the accommodating openings 130, 140 are clamped in the accommodating groove 123, i.e. between the end flange 120 and the sealing skirt 121. As a result, the flexible pressure valve 27 may possibly deform. Thus, a liquid-tight seal is formed.

Figure 3:
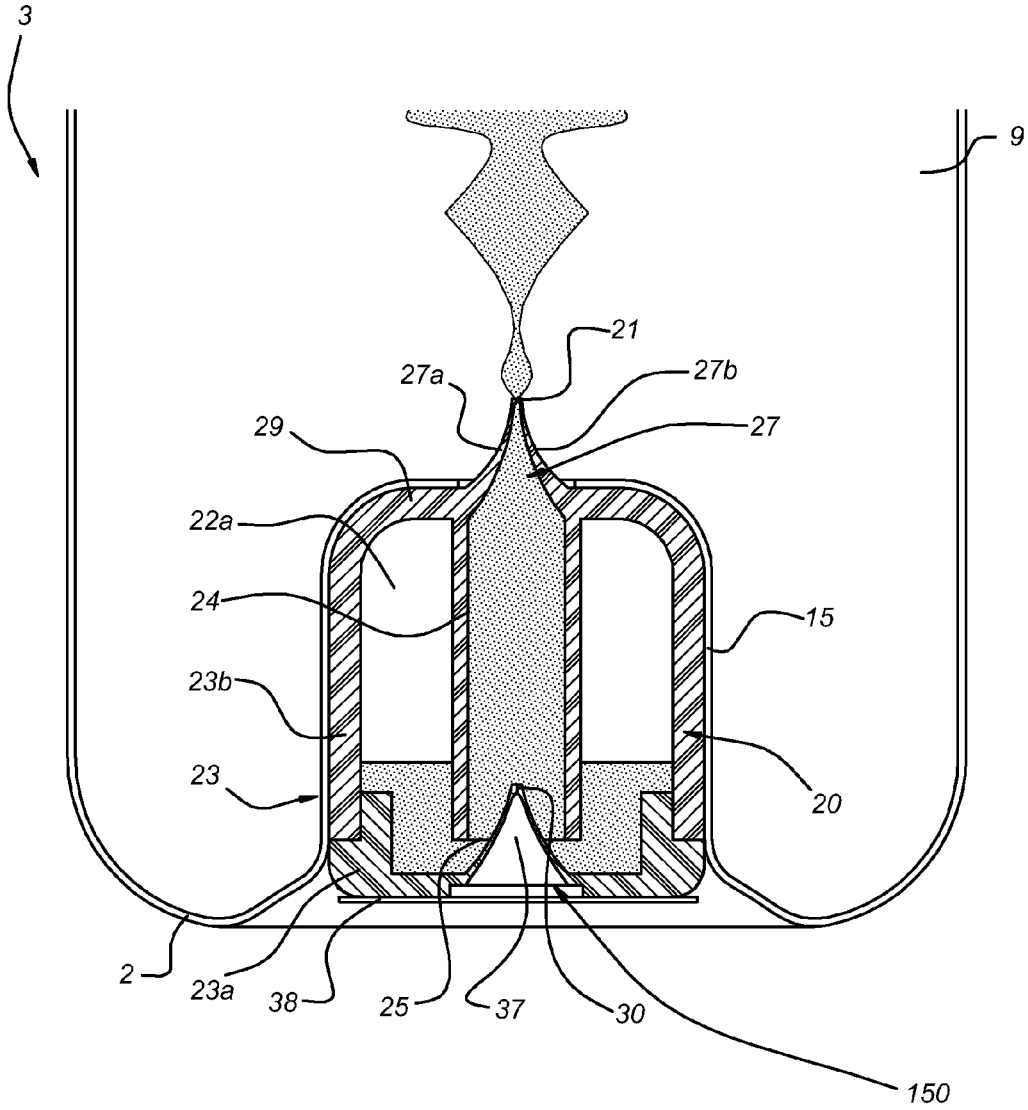
FIG. 3 shows detail III of FIG. 2.
Figure 4:
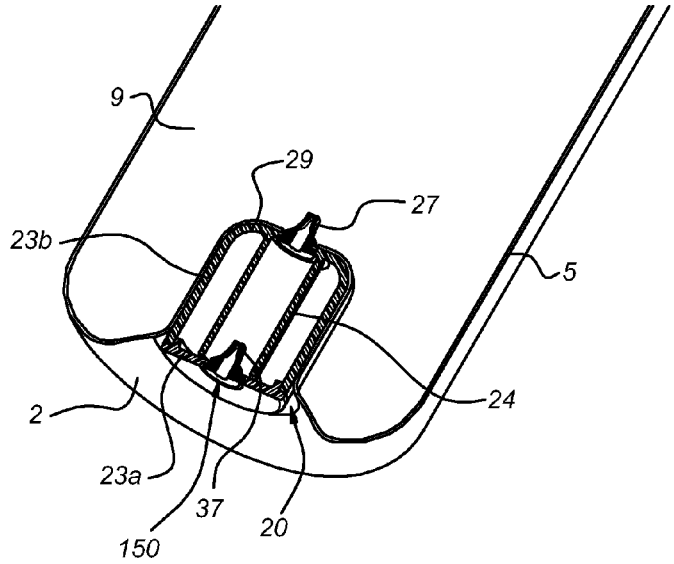
FIG. 4 shows a cross-sectional perspective view of a lower part of the container according to FIG. 1, wherein the container is empty.
Figure 5:
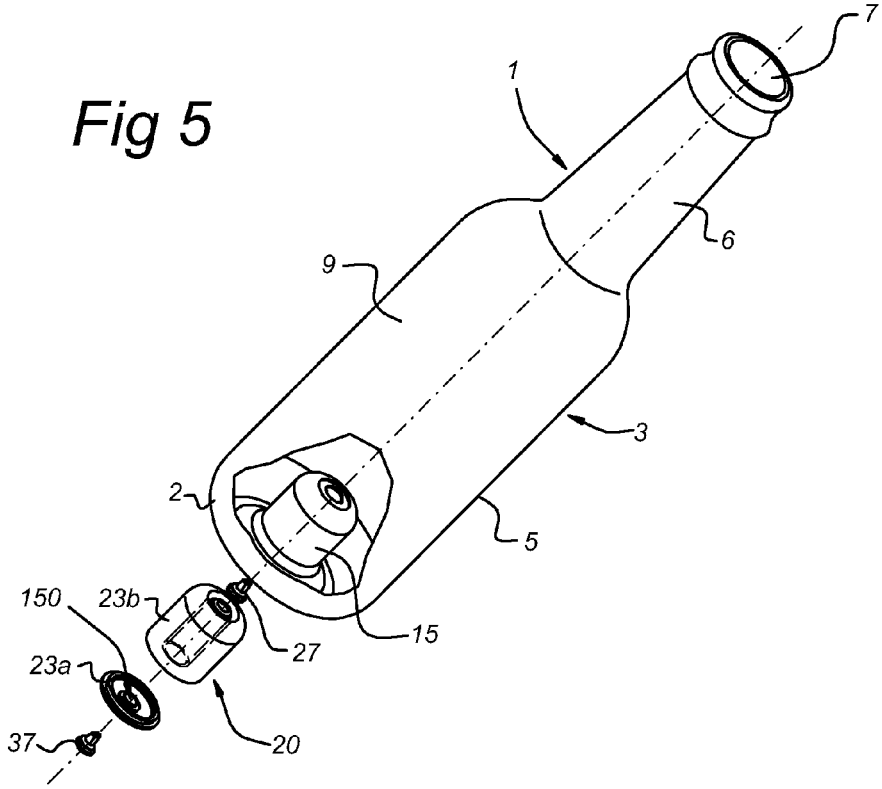
FIG. 5 shows an exploded perspective view of the container according to FIG. 1, wherein the container is empty and the closure member has been omitted.

As shown most clearly in FIG. 3, the additive chamber 20 comprises an access opening 150 that opens to the exterior of the container 1. The access opening 150 extends in the bottom wall 23*a*. In this exemplary embodiment, the access opening 150 is provided with a further pressure valve 37. However, the access opening 150 may also be provided with a plug or any other sealing means.

The additive chamber 20 furthermore has a supply opening 30 for supplying the additive. The supply opening 30 is arranged into the further pressure valve 37, which is a one-way valve. In this exemplary embodiment the pressure valve 37 forms a duckbill valve similar to the pressure valve 27, wherein the function and operation of these pressure valves 27, 37 correspond to each other. Depending on the application the pressure valve 37 can be constructed differently.

Thus, the pressure valve 37 has a closed position when the pressure $p_2$ inside the additive chamber 20 is higher than the ambient pressure $p_{atm}$, and has an open position for supplying additive into the additive chamber 20 and/or for pressurising the additive chamber 20 when the pressure $p_a$ exerted on the pressure valve 37 from outside the additive chamber 20 is higher than the pressure $p_2$ inside the additive chamber 20.

A tamper-evident member 38 is mounted on the pressure valve 37 at the base 2 of the container 1. The tamper-evident member 38 is shown diagrammatically in FIG. 3 as a sticky tamper-evident cover. However, the tamper-evident member 38 can be constructed in a different way, such as a welded plug.

The volume of the additive supplied to the additive chamber 20 is smaller than the volume of the additive chamber 20 itself. When the container 1 has an upright position, the additive level within the holder 23 will be located below the top wall 29. It is noted that in this exemplary embodiment the additive level in the discharge tube 24 is equal to the additive level in the holder 23 (see FIG. 1). Thus, a head space 22 is kept clear in the additive chamber 20.

The head space 22 comprises a head space portion 22*a* within the holder 23 between the additive level and the top wall 29, as well as a head space portion 22*b* within the discharge tube 24. The head spaces 22*a*, 22*b* comprise pressurized gas. As a result the pressure $p_2$ inside the additive chamber 20 is higher than the ambient pressure $p_{atm}$. However, the overpressure in the additive chamber 20 does not exceed the overpressure in the product chamber 9. Thus the pressure $p_2$ inside the additive chamber 20 is lower than the pressure $p_1$ inside the product chamber 9. The additive chamber 20 can be filled with the additive under the desired pressure $p_2$ using known bottling technology, wherein the charging pressure $p_a$ is lower than the pressure $p_1$ inside the product chamber 9.

The use of the container 1 according to the invention is as follows. Until the time of consumption the closure member 11 closes off the product opening 7, so that the pressure valve 27 has the closed position. The product and the additive are then kept separate from each other within the container 1. Thus, the product and additive cannot deteriorate under the influence of the other. In order to consume the beverage the consumer opens the container 1, i.e. removes the closure member 11 from the product opening 7 (see FIG. 2). Then, the pressure $p_1$ inside the product chamber 9 drops below the pressure $p_2$ inside the additive chamber 20, which opens the pressure valve 27.

Consequently, the pressurized head space portion 22*b* in the discharge tube 24 vents into the product space 9. Also, the pressurized gas of the head space portion 22*a* in the holder 23 flows towards the discharge opening 21 of the pressure valve 27. This pressurized gas will drive the liquid additive through the passage opening 25 and upwards in the discharge tube 24. After all, the pressurized gas in the head space portion 22*a* in the holder 23 is separated from the pressurized gas in the head space portion 22*b* of the discharge tube 24 by the liquid additive. Thus, the liquid additive is injected via the discharge opening 21 of the pressure valve 27 into the product chamber 9. The additive is released into the product simply by opening the container 1, because the container 1 according to the invention is pressure driven. This is user-friendly.

It is noted that the container 1 according to the invention can be manufactured in various ways. Possibly, the additive chamber 20 will be fitted within the cavity 15 only after the product chamber 9 has been filled with product and pressurized. In this case, during filling and pressurizing the product chamber 9, the accommodating opening 140 in the base of the container 1 is sealed, for example with the pressure valve 27. After fitting the additive chamber 20 to the product chamber 9, the pressure valve 27 also seals the accommodating opening 130 of the additive chamber 20. The additive chamber 20 will then be filled with the additive.

One of the methods for providing the container according to the invention will now be described as an example.

First, the product chamber 9 and the additive chamber 20 are assembled, wherein the pressure valve 27 enables communication therebetween. In this case, the product chamber 9 forms a bottle having a cavity 15 in its base 2, wherein the additive chamber 20 is received in the cavity 15. Then, the product chamber 9 is filled with the product through the product opening 7 and the closure member 11 is installed for closing off the product chamber 9. The mass of the product will close the pressure valve 27. If the product is carbonated, the $CO_2$ will also contribute to keeping the pressure valve 27 in its closed position.

Thereafter, an overpressure is applied to the pressure valve 27, which will open until the product chamber 9 is at the desired pressure $p_1$. When the overpressure is created in this manner, the pressure $p_1$ in the product chamber 9 can be accurately controlled. Next, the pressure $p_1$ is removed from the pressure valve 27, i.e. it will close.

Now the additive is introduced into the additive chamber 20. Although the further pressure valve 37 can already be installed from the start, it is preferred that it is mounted only now to minimize the risk of damaging. Subsequently, the additive chamber 20 is pressurized to the desired overpressure $p_2$ through the further pressure valve 37. Before filling of the additive chamber 20 the pressure therein is preferably low, i.e. below the ambient pressure $p_{atm}$. During filling the pressure $p_a$ applied to the pressure valve 37 is kept slightly above the pressure prevailing in the additive chamber 20. This ensures that the additive chamber 20 can be filled with the desired amount of additive. Moreover, the risk of leakage to the product chamber 9 is minimal. Finally, a seal 38 is mounted on the further pressure valve 37. The seal ensures that the container is tamper-evident and prevents leakage to the environment.

As an alternative, the overpressure in the product chamber 9 can be applied at filling of the product chamber 9 using a known bottling line. Usually a droplet of liquid nitrogen falls into the product and immediately the closure member is mounted. The droplet boils in the head space creating an overpressure. Although the product chamber can be pressurized using nitrogen dosing, the overpressure cannot be adjusted as accurately as when the overpressure is applied through the pressure valve 27.

If the additive comprises two or more liquid compositions that separate after mixing, for example compositions having different densities and/or chemical compatibility, it may be possible to keep these multiple compositions together in the additive chamber. However, if the multiple compositions degenerate in the presence of each other, the additive chamber 40 shown in FIGS. 7*a*-7*c* can be used.

The additive chamber 40 shown in FIGS. 7*a*-7*c* comprises a holder having two spaces 41, 42 that are separated from each other by a separation wall 43. Each separated space 41, 42 is adapted for containing one additive composition. The holder comprises a bottom wall 45 and a circumferential wall 46 that extends from the bottom wall 45. The bottom wall comprises two supply valves for supplying the additive compositions to the respective separated spaces 41, 42. A top wall 49 closes the holder.

Both separated spaces 41, 42 are connected to the product chamber by pressure valves 47 that are mounted on the top wall 49. Each pressure valve 47 has a closed position when the pressure ($p_1$) inside the product chamber is higher than the pressure ($p_2$) inside the corresponding separated space 41, 42 of the additive chamber 40. Each pressure valve 47 has an open position for discharging additive from said corresponding separated space 41, 42 of the additive chamber 40 into the product chamber when the pressure ($p_1$) inside the product chamber is lower than the pressure ($p_2$) inside said corresponding separated space 41, 42 of the additive chamber. Obviously, the additive chamber for containing multiple incompatible compositions can be constructed differently.

FIG. 9 shows an alternative embodiment wherein the additive chamber is mounted into the closure member 11. The same or similar components as described above are designated by the same reference numerals. The arrangement, operation and advantages as described above are also applicable to the container having the additive chamber within the closure member, in this example, a screw cap. However, in this embodiment a discharge tube is not necessary, because the additive adjoins the pressure valve 27 and the head space 22 in the additive chamber is located above the additive under the influence of gravity. Attachment of the additive chamber to glass, e.g. the wall of a beer bottle, may be difficult. When the additive chamber is attached to the closure member, for example a crown cap, the material of the product chamber is not relevant anymore.

The invention is expressly not limited to the exemplary embodiments shown in the figures. Because the terms "product" and "additive" merely indicate two compositions, they can each comprise one or more components and/or ingredients. In other words, the product and/or the additive do not have to be one component, but can be a composition of components as well. For example, the product comprises a two-phase mixture and/or the additive comprises one active component and a filler. The amounts of product and additive can vary—the amount of additive in the additive chamber may be a range of sizes and volumes according to product requirements.

The container 1 is suitable for various beverages or drinks. The container according to the invention enables numerous new combinations of products and additives. The product in the product chamber may comprise water, beer, milk or any other liquid or paste. It is particularly advantageous for the additive chamber to contain vitamins, proteins and/or peptides, such as casein hydrolysates, carotenoids, such as lycopene, anti-oxidant, such as quercitin, flavourants or a combination thereof. The additive may also comprise still other ingredients.

Although the container according to the invention has been described for beverages, it may contain various other products. The container according to the invention is advantageous for each application desiring two components that are kept separate until use.

For example, the container according to the invention may contain a pharmaceutical composition, in particular a medicament that requires mixing of different components only at the time of use. The container according to the invention provides accurate dosing of these different components—human mistakes are excluded because dosing is automatic. Moreover, the mixing of the different components is completely hygienic.

Furthermore, the container according to the invention may be adapted for cosmetic applications. The cosmetic industry has developed packages for lotions and skin systems that rely on mixing of two or more components at the time of use, e.g. twin pack systems. However, these packages are relatively expensive and do not provide automatic mixing. The container according to the invention is also applicable for cosmetic products.

Other applications of the container according to the invention exist. The design and materials of the container according to the invention depend on the particular application. For example, a jar with a screw cap may be advantageous for medical applications. The jar can be made of plastics or glass.

The invention claimed is:

1. A container, comprising: a product chamber for containing a product, wherein the product chamber has a product opening that opens into the exterior, a closure member that is releasably mounted on the product opening, and an additive chamber for containing an additive, wherein the container comprises a pressure valve that connects the additive chamber and the product chamber with each other, which pressure valve has a closed position when the pressure ($p_1$) inside the product chamber is higher than the pressure ($p_1$) inside the additive chamber, and has an open position for discharging additive from the additive chamber into the product chamber when the pressure ($p_1$) inside the product chamber is lower than the pressure ($p_2$) inside the additive chamber and wherein the pressure ($p_1$) inside the product chamber is higher than the ambient pressure ($p_{atm}$) and the pressure ($p_2$) inside the additive chamber is both lower than the pressure ($p_1$) inside the product chamber and higher than the ambient pressure ($p_{atm}$), wherein the additive chamber comprises an access opening that opens to the exterior of the container, which access opening is sealed.

2. The container according to claim 1, wherein the access opening is provided with a further pressure valve that has a closed position when the pressure ($p_2$) inside the additive chamber is higher than the ambient pressure ($p_{atm}$), and has an open position defining a supply opening for supplying additive into the additive chamber and/or for pressurising the additive chamber when the pressure ($p_a$) exerted on the pressure valve from outside the additive chamber is higher than the pressure ($p_2$) inside the additive chamber.

3. The container according to claim 1, wherein the access opening is provided with a plug.

4. The container according to claim 1, wherein the product chamber is filled with a product leaving clear a head space comprising a pressurized gas at the pressure ($p_1$) that is higher than the ambient pressure ($p_{atm}$).

5. The container according to claim 1, wherein the additive chamber is filled with an additive leaving clear a head space comprising a pressurized gas at the pressure ($p_2$) that is both lower than the pressure ($p_1$) inside the product chamber and higher than the ambient pressure ($p_{atm}$).

6. The container according to claim 5, wherein the additive comprises a liquid, and wherein the additive chamber comprises a discharge tube that extends from a discharge opening, which discharge tube has an passage opening that is submerged into the liquid additive.

7. The container according to claim 6, wherein the additive chamber comprises a holder defining an interior that is in communication with the interior of the discharge tube via the passage opening.

8. The container according to claim 7, wherein a head space comprises a head space portion within the holder and a head space portion within the discharge tube, which head space portions are separated from each other by the liquid additive and the discharge tube wall.

9. The container according to claim 1, wherein the container comprises a base and a circumferential wall that extends from the base, wherein the product opening is provided at the end of circumferential wall facing away from the base, wherein the additive chamber is attached to the base of the container.

10. The container according to claim 9, wherein the base of the container comprises a cavity, and wherein the additive chamber is attached from the outside into the cavity.

11. The container according to claim 1, wherein the additive chamber is attached to the closure member that is releasably mounted on the product opening.

12. The container according to claim 11, wherein the access opening is provided in the closure member.

13. The container according to claim 1, wherein the additive chamber comprises an accommodating opening for accommodating the pressure valve, which accommodating opening is defined by a circumferential edge, and wherein the pressure valve comprises a flexible material, and is provided with an end flange and a circumferential sealing skirt at a distance from the end flange, and wherein said circumferential edge of the accommodating opening is clamped between the end flange and the sealing skirt.

14. The container according to claim 13, wherein the cavity comprises a further accommodating opening for accommodating the pressure valve, which further accommodating opening is defined by a further circumferential edge, and is aligned with the accommodating opening of the additive chamber, and wherein the circumferential edges of both accommodating openings are clamped between the end flange and the sealing skirt.

15. The container according to claim 1, wherein the pressure valve is a one way valve.

16. The container according to claim 1, wherein the additive comprises vitamins.

17. The container according to claim 1, wherein the additive comprises at least one of proteins, peptides, carotenoids, anti-oxidant, flavourants.

18. The container according to claim 1, wherein the product and the additive after mixing thereof comprise a farmaceutical composition, in particular a medicament.

19. The container according to claim 1, wherein the product and the additive after mixing thereof comprise a cosmetic composition.

20. The container according to claim 1, wherein the additive comprises at least two liquid compositions that separate after mixing, for example compositions having different densities and/or chemical compatibility.

21. The container according to claim 14, wherein the additive chamber comprises at least two separated spaces for containing one additive composition, respectively, wherein each separated space is connected to the product chamber by a pressure valve in each case, wherein each pressure valve has a closed position when the pressure ($p_1$) inside the product chamber is higher than the pressure ($p_2$) inside the corresponding separated space of the additive chamber, and has an open position for discharging additive from said corresponding separated space of the additive chamber into the product chamber when the pressure ($p_1$) inside the product chamber is lower than the pressure ($p_2$) inside said corresponding separated space of the additive chamber.

22. The container according to claim 21, wherein the pressure ($p_2$) inside the first separated space of the additive chamber differs from the pressure ($p_2$) inside the second separated space of the additive chamber.

23. The container according to claim 1, wherein the container is arranged to inject the additive into the product chamber such that the additive and the product are substantially homogeneously mixed in the product chamber.

24. Container according to claim 1, wherein the container is ready-for-use.

25. A method for filling a container, comprising:

providing a container, which container comprises a product chamber for containing a product, which product chamber has a product opening that opens into the exterior, providing an additive chamber for containing an additive, which additive chamber comprises a pressure valve that has a closed position when the pressure ($p_2$) inside the additive chamber is lower than the pressure ($p_1$) outside the additive chamber, and has an open position when the pressure ($p_2$) inside the additive chamber is higher than the pressure ($p_1$) outside the additive chamber, which pressure valve defines a discharge opening in the open position, wherein the additive chamber comprises an access opening that opens to the exterior, fitting the additive chamber to the product chamber such that the discharge opening of the pressure valve in the open position opens into the product chamber, filling the product chamber with a product, closing off the product chamber by releasably mounting a closure member on the product opening, pressurizing the product chamber to a pressure ($p_1$) that is higher than the ambient pressure ($p_{atm}$), filling the additive chamber with an additive via the access opening, which is thereafter closed, pressurizing the additive chamber to a pressure ($p_2$ ) that is both lower than the pressure ($p_1$) inside the product chamber and higher than the ambient pressure ($p_{atm}$).

26. The method according to claim 25, wherein the product chamber is pressurized by applying an overpressure to the pressure valve after the product chamber has been filled with the product and the closure member is mounted on the product opening.

27. The method according to claim 26, wherein the overpressure to the pressure valve is removed after the product chamber is pressurised to the pressure ($p_1$).

28. The method according to claim 25, wherein the additive chamber, being fitted in the container, comprises an access opening that opens into the exterior of the container, and wherein additive is supplied into the additive chamber through the access opening and/or the additive chamber is pressurised to a pressure ($p_2$) that is higher than the ambient pressure ($p_{atm}$) by applying said pressure ($p_2$) to the access opening.

* * * * *